United States Patent [19]

Wood

[11] Patent Number: 5,050,708

[45] Date of Patent: Sep. 24, 1991

[54] WHEELCHAIR TRANSFER MECHANISM

[76] Inventor: Gregg D. Wood, 3820 Orchard View Ave., Rochester Hills, Mich. 48063

[21] Appl. No.: 432,562

[22] Filed: Nov. 7, 1989

[51] Int. Cl.[5] ..... B66B 9/08

[52] U.S. Cl. ..... 187/12; 187/10; 187/11

[58] Field of Search ..... 187/10, 11, 12

[56] References Cited

U.S. PATENT DOCUMENTS

| | | | |
|---|---|---|---|
| 1,358,062 | 11/1920 | Davis | 187/12 |
| 1,956,650 | 5/1934 | Milner | 187/10 X |
| 2,507,887 | 5/1950 | Cheney | 187/12 |
| 2,563,260 | 8/1951 | Miller | 187/12 |
| 2,674,347 | 4/1954 | Thompson | 187/12 |
| 2,950,948 | 8/1960 | Hardigan et al. . | |
| 3,121,476 | 2/1964 | Mazzarelli . | |
| 3,229,788 | 1/1966 | Booth . | |
| 3,312,307 | 4/1967 | Camp . | |
| 3,749,202 | 7/1973 | Puls . | |
| 3,966,022 | 6/1976 | Cheney . | |
| 4,179,012 | 12/1979 | Heberle . | |
| 4,345,669 | 8/1982 | Noall . | |
| 4,354,575 | 10/1982 | Anderson . | |
| 4,438,830 | 3/1984 | Born . | |
| 4,457,402 | 7/1984 | Del Vecchio et al. . | |
| 4,564,086 | 1/1986 | Kingston . | |
| 4,627,517 | 12/1986 | Bor . | |
| 4,756,387 | 7/1988 | Grass . | |

FOREIGN PATENT DOCUMENTS

| | | |
|---|---|---|
| 0209293 | 8/1989 | Japan . |

*Primary Examiner*—Robert P. Olszewski
*Assistant Examiner*—Dean A. Reichard
*Attorney, Agent, or Firm*—Daniel H. Bliss

[57] ABSTRACT

The present invention is a wheelchair transfer mechanism for transferring a wheelchair over a stairway between a top and bottom landings in a staircase. The wheelchair transfer mechanism includes first and second guide rails mounted in vertically spaced relationship on each side wall of the staircase. The wheelchair transfer mechanism also includes a support platform movably mounted on the first and second rails and extending fully across the stairway. The wheelchair transfer mechanism further includes a drive means for moving the support platform along the first and second guide rails between the top and bottom landings of the stairway.

10 Claims, 3 Drawing Sheets

WHEELCHAIR TRANSFER MECHANISM

BACKGROUND OF THE INVENTION

1. Field of the Invention

The present invention relates generally to a lift for moving a wheelchair over a stairway, and more particularly to, a wheelchair transfer mechanism for transferring a wheelchair over a stairway.

2. Description of Related Art

In the past, there have been mechanisms for transferring a person in a wheelchair over a stairway when that person is physically unable to move up or down the stairs. One such mechanism is disclosed in U.S. Pat. No. 3,749,202 to Puls which is directed to a stairway seatcar elevator. The stairway seat car elevator has a pair of guide rails mounted on one side of a staircase in vertically spaced parallel relation and a seatcar extending between the rails for guided movement along the stairway. A drive assembly for moving the seatcar includes a pulley mounted on the frame of the seatcar and a cable fixed at the top of the stairs which is passed around the pulley and back to a cable drum which is driven by a reversible motor.

Another mechanism is disclosed in U.S. Pat. No. 4,345,669 to Noall which discloses a wheelchair lift. The wheelchair lift includes a ramp pivotally attached to a wall of a staircase and a support platform mountable and dismountable from a carriage assembly which rides along the ramp.

One disadvantage of the above patent mechanisms is that the support platform does not extend completely across the staircase. This results in the person and wheelchair not being fully supported and/or being supported in a cantilever manner. Another disadvantage is that the mechanism may not facilitate the easy entry and exit of a wheelchair, requiring assistance by another person. A further disadvantage is that the support platform for supporting the wheelchair is not guided upon a pair of support rails on each side wall of the staircase.

SUMMARY OF THE INVENTION

It is, therefore, one object of the present invention to provide a wheelchair transfer mechanism for transferring a wheelchair over a stairway.

It is another object of the present invention to eliminate supporting a wheelchair in a cantilever manner.

It is yet another object of the present invention to guide a support platform or lift for the wheelchair upon rails on each side wall of the staircase.

Briefly stated, to accomplish the foregoing objects, the present invention is a wheelchair transfer mechanism for transferring a wheelchair over a stairway between a top and bottom landings of a staircase. The wheelchair transfer mechanism includes two sets of first and second vertically inclined guide rails mounted in vertically spaced relationship with each set horizontally spaced from each other on each side wall of the staircase. The wheelchair transfer mechanism also includes a support platform movably mounted on the first and second guide rails and extending fully across the stairway. The wheelchair transfer mechanism further includes a drive means for moving the support platform along the first and second guide rails between the top and bottom landings of the stairway.

One advantage of the present invention is that a support platform for supporting the wheelchair extends completely across the staircase eliminating support in a cantilever manner. Another advantage of the present invention is that the support platform is guided along rails on each side wall of the staircase, providing improved guiding and support of the support platform. A further advantage of the present invention is that the support platform maintains its generally horizontal or planar position during movement between top and bottom landings of the stairway. Yet another advantage of the present invention is that it is capable of supporting up to one thousand pound (1000 lbs) loads. Still yet another advantage of the present invention is that it eliminates the need for a second wheelchair and the need to transfer the patient over a stairway which is dangerous.

Other objects, features and advantages of the present invention will be readily appreciated as the same becomes better understood by reference to the following description when considered in connection with the accompanying drawings.

DESCRIPTION OF THE PREFERRED EMBODIMENT

Figure 1:
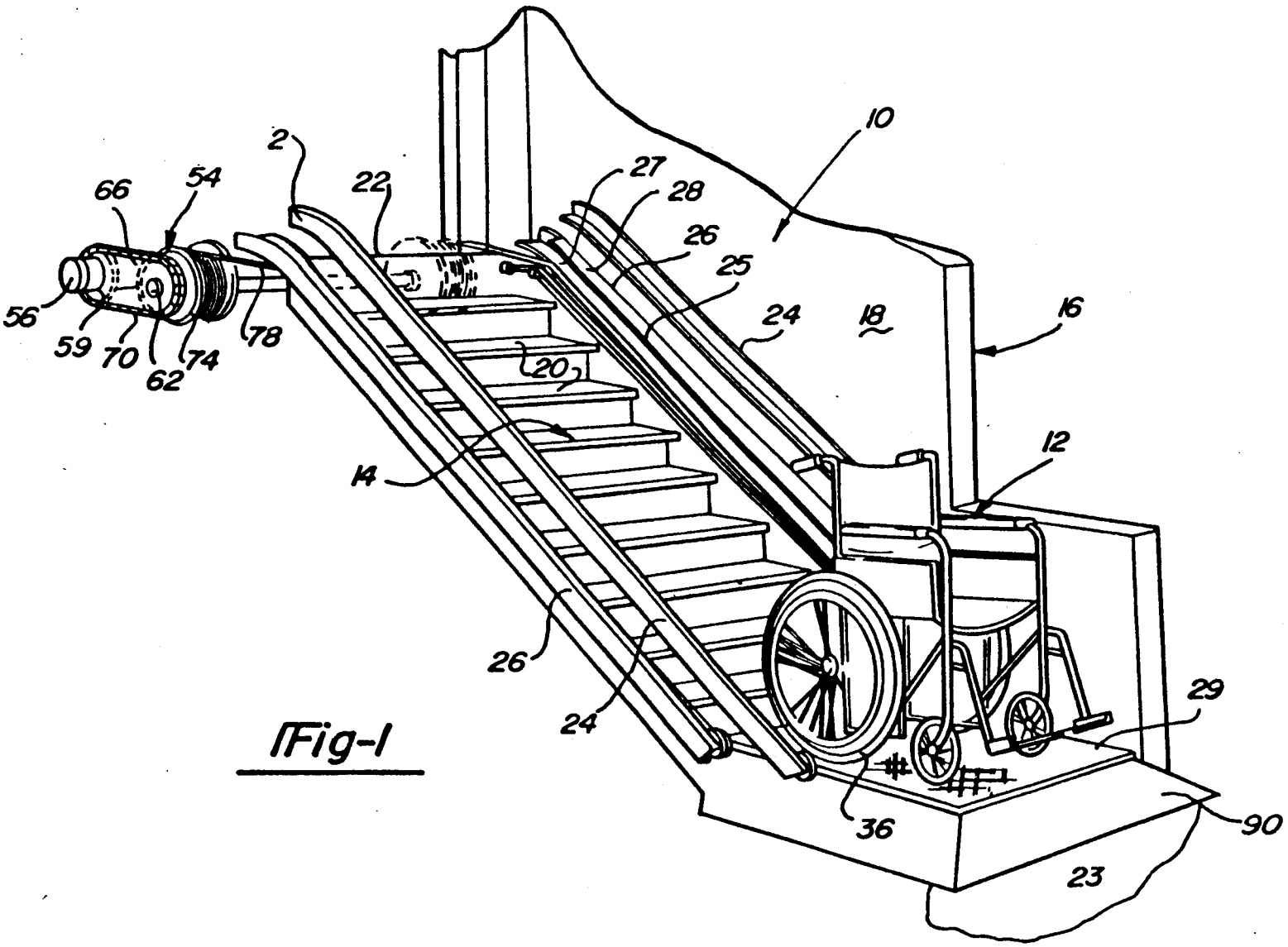
FIG. 1 is a perspective view of a wheelchair transfer mechanism according to the present invention.

Referring to FIG. 1, a wheelchair transfer mechanism 10 is shown for transferring a wheelchair, generally indicated at 12. The wheelchair 12 is conventional and well known in the art. The wheelchair transfer mechanism 10 transfers or lifts the wheelchair 12 over a stairway, generally indicated at 14, of a staircase, generally indicated at 16. The staircase 16 has a pair of laterally spaced and generally vertically extending side walls 18. As noted in FIG. 1, only one side wall 18 is shown for illustrative purposes. The stairway 14 has a plurality of stairs 20 extending between the side walls 18 from a top landing 22 to a bottom landing 23. It should be appreciated that the stairway 14 and staircase 16 are conventional and well known in the art.

The wheelchair transfer mechanism 10 includes first and second guide rails 24 and 26 mounted in vertically spaced relation to each side wall 18. The first and second rails 24 and 26 extend above and along the stairs 20 from the top landing 22 to the bottom landing 23. The first guide rail 24 has a lower horizontal and transversely extending portion 25 to form a generally "L" shaped member. The first guide rail 24 is secured to the side wall 18 by suitable means such as fasteners (not shown) The second guide rail 26 has lower and upper horizontal and transversely extending portions 27 and 28 to form a generally "U" shaped cross-section. The second guide rail 26 is disposed below the first guide rail 24. The second guide rail 26 is secured to the side wall 18 by suitable means such as fasteners (not shown). It should be appreciated that any suitable means may be used to secure the guide rails 24 and 26 to the side walls 18. It should also be appreciated that the first and second guide rails 24 and 26 have an arcuate shaped end near the top landing 22.

Figure 6:
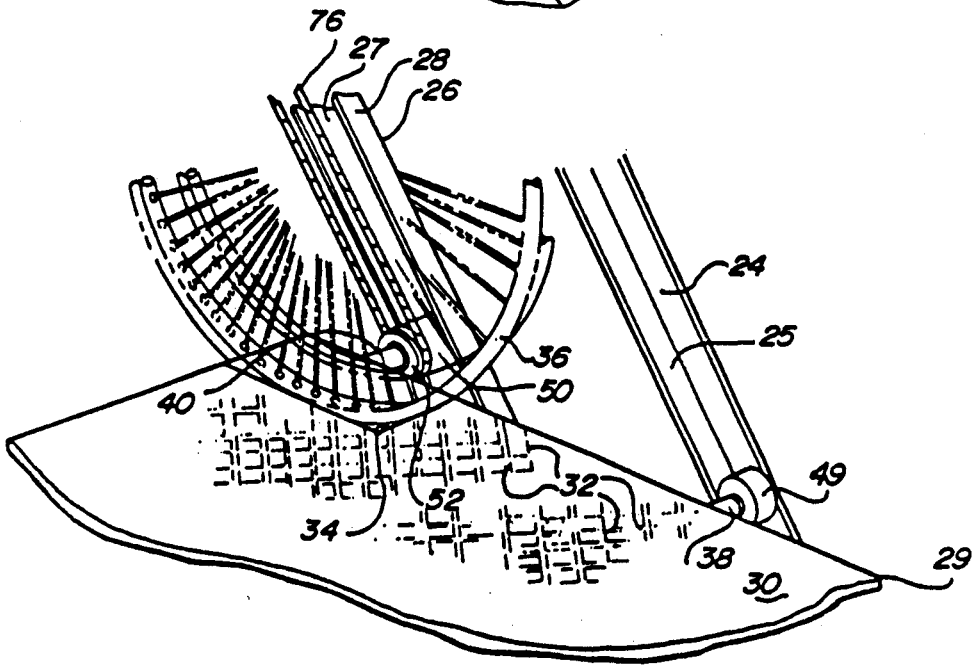
FIG. 6 is a partial perspective view of a portion of the support platform and wheelchair of FIG. 1.

The wheelchair transfer mechanism 10 also includes a support platform 29 adapted to translate along the guide rails 24 and 26. The support platform 29 is generally rectangular and planar in shape. As illustrated in FIG. 6, an upper surface 30 of the support platform 29 includes a plurality of raised portions 32 to act as a friction means for the wheels of the wheelchair 12. In one form of the invention, the raised portions 32 are formed in a generally diamond shaped pattern, it is understood of course, that other shapes could be used. The support platform 29 also includes a pair of laterally spaced recesses or wheel wells 34 extending downwardly from the upper surface 30. The wheel wells 34 are generally arcuate in shape and adapted to receive the correspondingly shaped rear wheels 36 of the wheelchair 12. The wheel wells 34 act as a stop to limit movement of the rear wheels 36 of the wheelchair 12 relative to the support platform 29.

Figure 4:
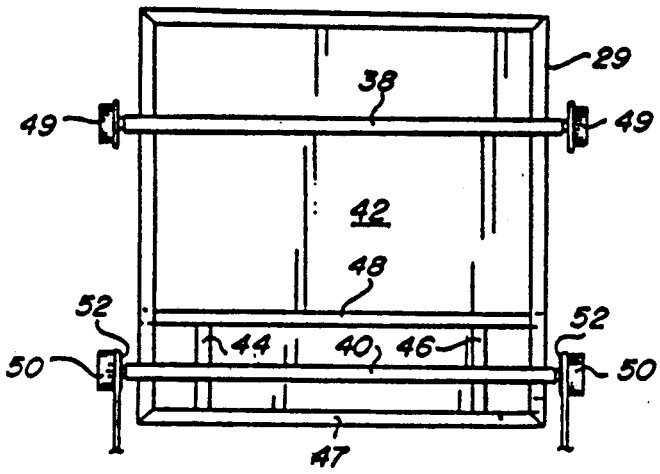
FIG. 4 is a bottom view of the support platform for the wheelchair transfer mechanism of FIG. 1.

Referring to FIG. 4, the support platform 29 includes a pair of laterally extending and longitudinally spaced rod members 38 and 40. The rod members 38 and 40 are secured to a bottom surface 42 of the support platform 29 by suitable means such as welding. The rod member 40 may also be secured to a pair of laterally spaced and longitudinally extending support members 44 and 46. The support members 44 and 46 are secured by suitable means such as welding at one end to a downwardly extending outer frame 47 and a transversely extending cross member 48 of support platform 29.

The rod members 38 and 40 include a rotatable roller 49 and 50, respectively, rotatably secured at each end. The rollers 49 and 50 are adapted to ride or translate along the guide rails 24 and 26. The rollers 49 ride or contact lower horizontal portion 25 of the first guide rail 24 and the rollers 50 are disposed within the second guide rail 26 and may contact either lower or upper horizontal portion 27 and 28, respectively. The rod member 40 also includes a pulley 52 rotatably secured at each end adjacent the roller 50.

Figure 5:
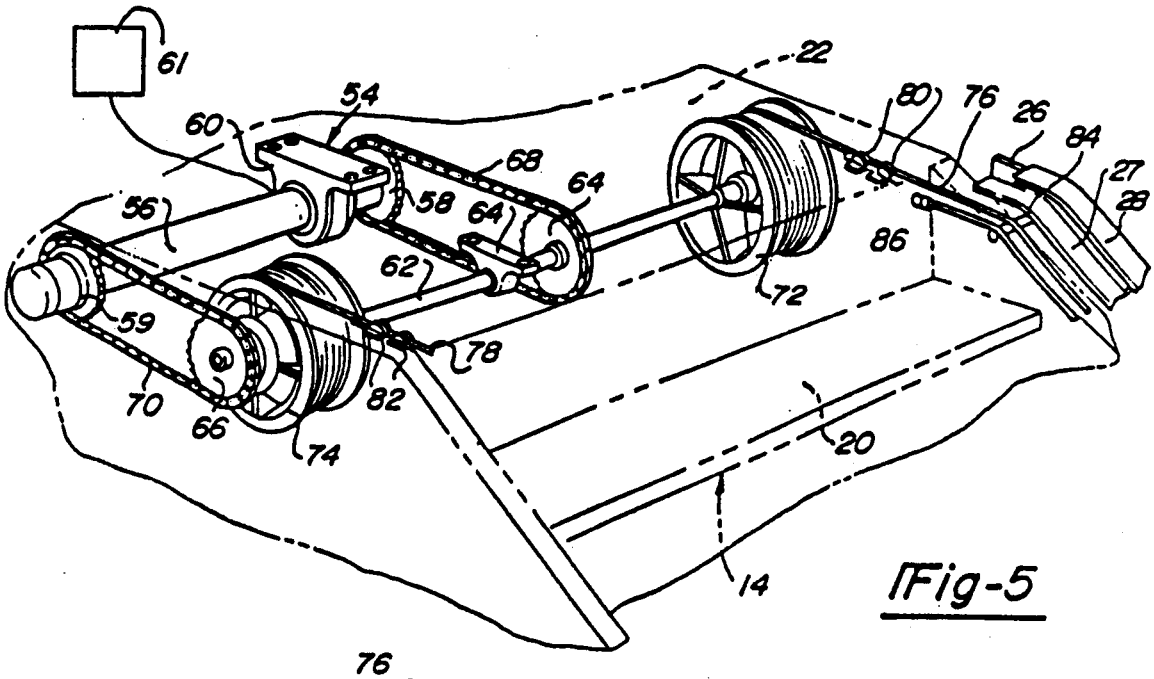
FIG. 5 is a perspective view of a drive mechanism for the wheelchair transfer mechanism of FIG. 1.

Referring to FIGS. 1, 4 and 5, the wheelchair transfer mechanism 10 further includes a drive mechanism or assembly, generally indicated at 54. The drive assembly 54 includes a reversible motor 56 shaped as an elongated cylinder with gears or sprockets 58 and 59 transversely spaced and disposed near each end of the reversible motor 56. The reversible motor 56 is journally or rotatably supported by means of a bracket 60. The bracket 60 is secured to the underside of the top landing 22 by suitable means such as fasteners (not shown). The reversible motor 56 is electrically connected to a control circuit and power source 61.

The drive assembly 54 also includes a laterally extending shaft 62 longitudinally spaced from the reversible motor 56 and journally or rotatably supported by bracket 64. The bracket 64 is secured by suitable means such as fasteners (not shown) to the underside of the top landing 22. The shaft 62 includes gears or sprockets 64 and 66 which are aligned with the sprockets 58 and 59 of the reversible motor 56. A first and second chain 68 and 70 are disposed about and interconnect sprockets 58, 64 and 59, 66, respectively, to allow the reversible motor 56 to drive the shaft 62.

The drive assembly 54 further includes generally cylindrical drums 72 and 74 fixedly secured to the shaft 62 near each end. The drums 72 and 74 include a cable 76 and 78 wrapped about each drum 72 and 74, respectively. The cables 76 and 78 extend from the drum 72 and 74 and are passed through cable guides 80 and 82, respectively, which are secured to an upper surface of top landing 22 to maintain the cables 76 and 78 in a generally horizontal orientation. The cables 76 and 78 extend over a transversely extending cylindrical guide 84 and into and along second guide rail 26. The cables 76 and 78 are passed around the pulley 52 of the support platform 29 as illustrated in FIGS. 4 and 6. The cables 76 and 78 extend upwardly along second guide rail 26 and over guide 84 and are fastened by a suitable fastener 86 to the top landing 22 of the stairway 14 as illustrated in FIG. 5. The reversible motor 56 drives the drums 72 and 74 to retract or release cables 76 and 78 to raise or lower the support platform 29, respectively.

Figure 2:
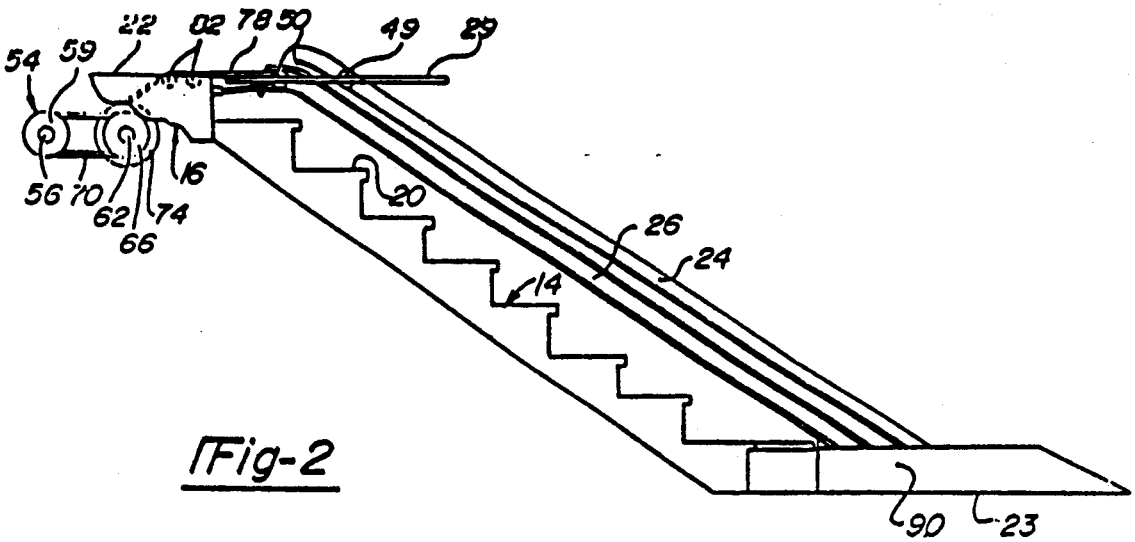
FIG. 2 is a side elevational view of the wheelchair transfer mechanism of FIG. 1.

Referring to FIG. 2, the arcuate ends of the first and second guide rails 24 and 26 allow the support platform 29 to be planar or flush with the top landing 22 when the cables 76 and 78 are fully retracted. As illustrated in FIG. 1, when the cables 76 and 78 are fully extended, the support platform 29 rests upon a platform housing 90 such that the support platform 29 is flush or planar with the top of a bottom stair 20 which rests on bottom landing 23. The platform housing 90 is generally rectangular in shape and inclined to provide a ramp to enter or exit the support platform 29 with the wheelchair 12. It should be appreciated that the platform housing 90 rests upon the bottom landing 23 and may be secured by suitable means to the stairway 14.

Figure 3:
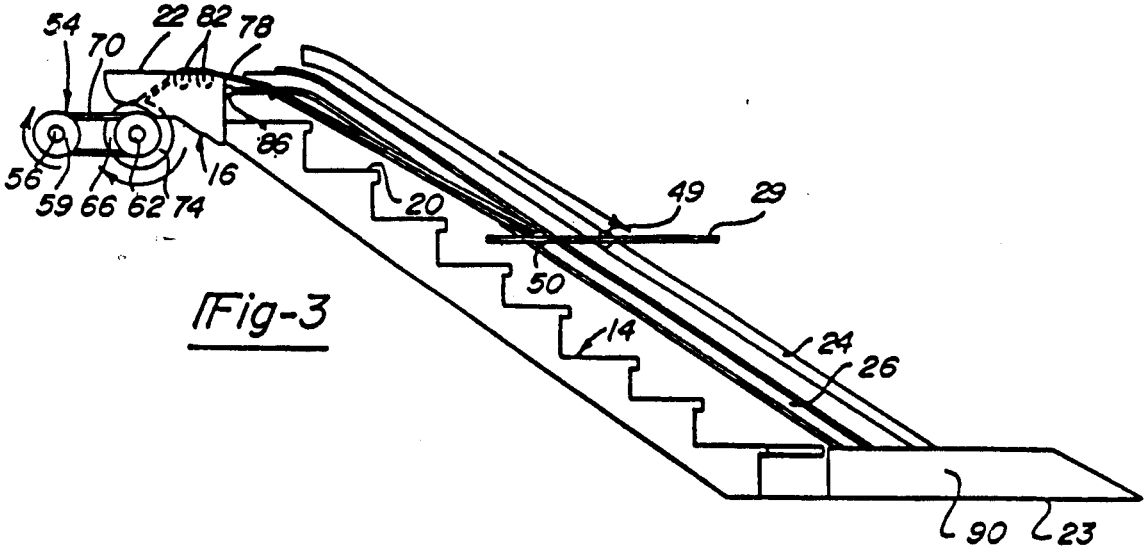
FIG. 3 is a view similar to FIG. 2 with a support platform for the wheelchair transfer mechanism in a translated position.

In operation, as illustrated in FIG. 2, the support platform 29 is planar or horizontal and flush with the top landing 22. A person in the wheelchair 12 enters from the top landing 22 and moves the wheelchair 12 onto the support platform 29 until the rear wheels 36 enter the wheel wells 34 and limit or stops the wheelchair 12 relative to the support platform 29. The person activates a switch (not shown) electrically connected to the control circuit and power source 61 to rotate reversible motor 56. As illustrated in FIG. 3, rotation of reversible motor 56 causes shaft 62 and drums 72 and 74 to rotate. Rotation of drums 72 and 74 extends cables 76 and 78. As a result, rollers 49 and 50 travel along guide rails 24 and 26, lowering support platform 29. Support platform 29 will be lowered until it rests upon platform housing 90. The person can then move the wheelchair 12 off the support platform 29 and down platform housing 90 to bottom landing 23. The operation is reversed for traveling from the bottom landing 23 to the top landing 22.

It should be appreciated that switches for activating the drive assembly 54 are placed near the top and bottom landings 22 and 23. It should also be appreciated that the control circuit and power source 61 include limit switches or a timer for stopping the motor 56 such that the support platform 29 is flush with the top landing 22 or rests upon platform housing 90.

The present invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the present invention may be practiced otherwise than as specifically described.

What is claimed is:

1. A wheelchair transfer mechanism for transferring a wheelchair over a stairway between top and bottom landings in a staircase, comprising:

guide rail means mounted on each side of the staircase;

support platform means movably mounted on said guide rail means and extending fully across the stairway for supporting a wheelchair;

a drive means for moving said support platform means along said guide rail means between the top and bottom landings of the stairway;

said guide rail means comprising first and second guide rails mounted in vertically spaced relationship;

said support platform means comprising a support platform being generally planar and having first and second rod members being longitudinally spaced and transversely extending and secured to a bottom side of said support platform;

said first and second rod members including a roller rotatably mounted to each end and adapted to translate along said first and second guide rails, respectively;

said support platform adapted to receive a wheelchair and including means for limiting movement of the wheelchair relative to said support platform.

2. A mechanism as set forth in claim 1 wherein said second rod member includes a pulley secured adjacent said roller.

3. A mechanism as set forth in claim 2 wherein said drive means comprises a drum, cable wound about said drum and having one end fixed at the top landing of the stairway and passed around said pulley, and a motor for rotating said drum for extending and retracting the other end of said cable to move said support platform up and down the stairway.

4. A mechanism as set forth in claim 1 wherein said first guide rail includes a lower horizontal portion extending transversely, said roller of said first rod member being adapted to contact said lower horizontal portion.

5. A mechanism as set forth in claim 4 wherein said second guide rail includes lower and upper horizontal portions extending transversely, said roller of said second rod member being adapted to contact either said lower or upper horizontal portion and disposed therebetween.

6. A wheelchair transfer mechanism for transferring a wheelchair over a stairway between top and bottom landings in a staircase, comprising:

first and second guide rails mounted in vertically spaced relationship on each side wall of the staircase;

a support platform movably mounted on said first and second guide rails and extending fully across the stairway, said support platform including first and second rod members being longitudinally spaced and transversely extending and secured to a bottom side of said support platform and having a roller rotatably mounted to each end and adapted to translate along said first and second guide rails, respectively;

said support platform including an upper surface and a pair of laterally spaced recesses extending downwardly from said upper surface and adapted to receive wheels of the wheelchair; and a drive means for moving said support platform along said first and second guide rails between the top and bottom landings of the stairway.

7. A mechanism as set forth in claim 6 wherein said first guide rail includes a lower horizontal portion extending transversely, said roller of said first rod member being adapted to contact said lower horizontal portion.

8. A mechanism as set forth in claim 7 wherein said second guide rail includes lower and upper horizontal portions extending transversely, said roller of said second rod member being adapted to contact either said lower or upper horizontal portion and disposed therebetween.

9. A mechanism as set forth in claim 8 wherein said second rod member includes a pulley secured adjacent said roller.

10. A wheelchair transfer mechanism for a stairway between top and bottom landings in a staircase, comprising:

a wheelchair having front and rear wheels and adapted to sea a person;

first and second guide rails mounted in vertically spaced relationship on each side wall of the staircase;

a support platform extending fully across the stairway between said first and second guide rails and movably mounted on said first and second guide rails;

a drive means for moving said support platform along said first and second guide rails between the top and bottom landings of the stairway;

said support platform including first and second rod members being longitudinally spaced and transversely extending and secured to a bottom side of said support platform;

said first and second rod members including a roller rotatably mounted to each end and adapted to translate along said first and second guide rails, respectively;

said support platform including an upper surface and a pair of laterally spaced recesses extending downwardly from said upper surface, said recesses being generally arcuate in shape to receive said rear wheels of said wheelchair;

said second rod member including a pulley secured adjacent said roller;

said first guide rail including a lower horizontal portion extending transversely, said roller of said first rod member being adapted to contact said lower horizontal portion;

said second guide rail including lower and upper horizontal portions extending transversely, said roller of said second rod member being adapted to contact either said lower or upper horizontal portion and disposed therebetween; and said drive means including a drum, cable wound about said drum and having one end fixed at the top landing of the stairway and passed around said pulley, and a motor for rotating said drum to extend and retract the other end of said cable to move said support platform up and down the stairway.

* * * * *